United States Patent [19]

Fukuma et al.

[11] Patent Number: 4,685,769

[45] Date of Patent: Aug. 11, 1987

[54] DISPLAY DRIVE CIRCUIT

[75] Inventors: Tositaka Fukuma, Yamatokoriyama; Masaharu Satoh, Nara, both of Japan

[73] Assignee: Sharp Kabushiki Kaisha, Osaka, Japan

[21] Appl. No.: 643,880

[22] Filed: Aug. 24, 1984

[30] Foreign Application Priority Data

Sep. 5, 1983 [JP] Japan ..... 58-163604

[51] Int. Cl.[4] ..... G07G 3/29

[52] U.S. Cl. ..... 350/332; 350/333

[58] Field of Search ..... 350/332, 333; 346/154; 364/518, 514; 340/792, 794, 798–801, 807

[56] References Cited

U.S. PATENT DOCUMENTS 4,499,459 2/1985 Sasaki et al. ..... 350/333

*Primary Examiner*—Arthur G. Evans

*Attorney, Agent, or Firm*—Birch, Stewart, Kolasch & Birch

[57] ABSTRACT

A display drive circuit using a plurality of the segment driver LSIs of the same kind, which substantially inverts the direction of the LSI pin array by switching into any specific mode required. Specifically, the display drive circuit causes the orders of the column addresses of the display memory and the bits to be inverted by applying the mode select signals. The preferred embodiment effectively eliminates the crossed wiring conventionally applied, while achieving the most efficient use of the printed circuit boards and making it possible to install multi-terminal LSIs in the limited space and a multi-dutied LCD unit as well.

5 Claims, 9 Drawing Figures

| COLLIMN ADDRESS / ROW ADDRESS | 0 | 1 | ------ | 9 |
|---|---|---|---|---|
| 0 | 10001000 | | | 00001111 |
| 1 | 01000100 | | | 00011111 |
| ⋮ | | | | |
| 38 | 00111100 | | | 01111111 |
| 39 | 00011000 | | | 11111111 |

DISPLAY DRIVE CIRCUIT

BACKGROUND OF THE INVENTION

The present invention relates to an LCD display drive circuit.

Conventionally, there are a variety of display elements made available for computers and associated equipment. Recently, reflecting an increasing demand for minimum power consumption, minimum space, and higher quality, LCD drive circuits have been mostly designed to sustain multiple duties, and at the same time, overall characteristics of LCD units and efficiency of the lead terminals have been greatly improved. To make up an 80×640 dot panel display as shown in FIG. 1, a typical configuration of the LCD display, at least one back plate driver LSI and additional 16 segment driver LSIs are needed. Nevertheless, it is quite difficult to completely install these 17 LSIs into a specific circuit board having only 66 mm×256 mm of available area and 1,360 pieces of lead wires (640×2+80) even if a multiple-layer printed circuit board can be made available as required.

OBJECT & SUMMARY OF THE INVENTION

The present invention therefore aims at providing such a configuration that completely eliminates crossed wiring. Specifically, the present invention eliminates crossing of wires by writing the needed patterns into segment driver LSIs SD1 through SD16 in order that these patterns can be all aligned in the same direction, and also by substantially switching the LSI pin array so that these LSIs can be completely installed in position even after they are repositioned in small patterns that contain the distributed wires. In other words, using such an LCD display drive that employs a plurality of the segment driver LSIs of the same kind, the present invention has made it possible to substantially invert the direction of the LSI pin array using a specifically selected mode. By effectively using such a display drive circuit that contains a display memory storing dot patterns for display and generates the needed segment signals in response to a specific information read out of the display memory, the present invention provides means for inverting the orders of the column addresses of the display memory and the bits as well by effectivley applying the mode select signals. Details are described below.

FIG. 2 shows an example in which conventional LCD driver LSIs SD1', —SD9', —are installed. CDL denotes the common data line. FIG. 1 shows the status of the patterns and terminals of these LCD display elements. In other words, a pair of dot matrixes each comprising 640 segments×40 back plates are provided in the same celi. As shown in FIG. 1, the segment lead terminals of an LCD containing many dots cause the data signal to go out of the upper and lower ends. As a result, when a LCD unit is driven by a plurality of segment driver LSIs, as shown in FIG. 2, all the conventional units cause the segment driver SD9' driving the segments of one-side of the display to use segment lead wire positions which unavoidably cross each other, and therefore, a multiple-layer wiring board has been compulsorily employed. Nevertheless, if the LCD terminal requires a still narrower pitch, all the needed display elements can not readily be installed when using the conventional installation methods.

DETAILED DESCRIPTION OF THE INVENTION

Figure 1:
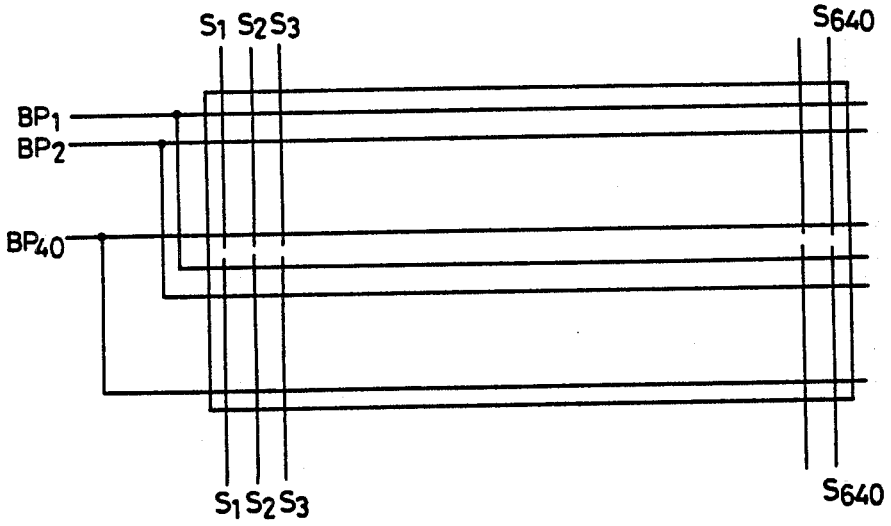
FIG. 1 shows the status of the patterns used by a conventional 80×640 dot LCD panel and its terminals.
Figure 3:
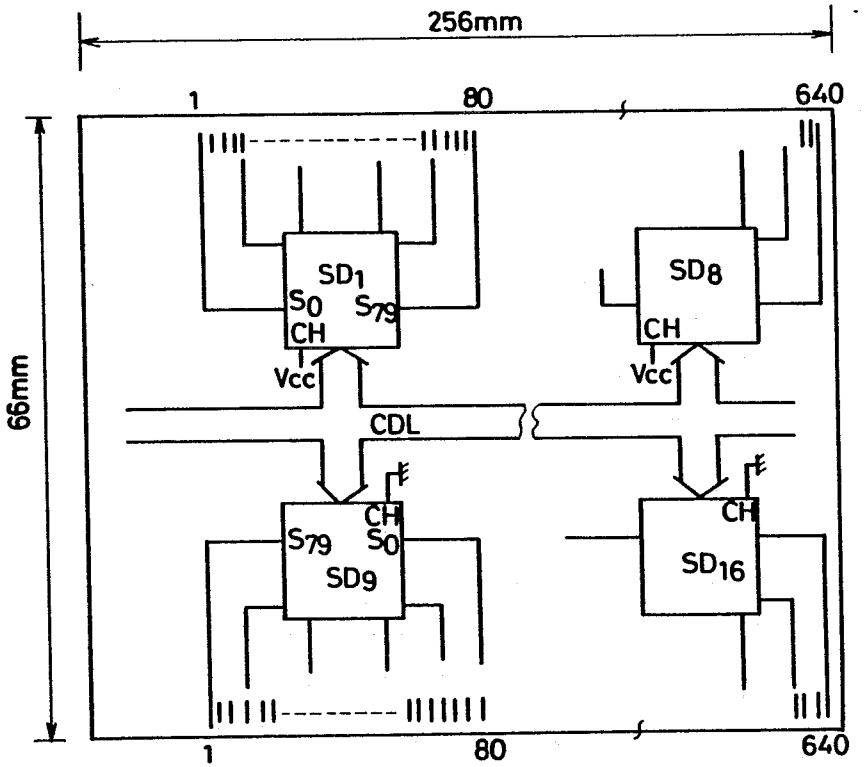
FIG. 3 shows the status in which segment driver LSIs that drive the LCD unit are installed according to the preferred embodiment of the present invention.
Figure 2:
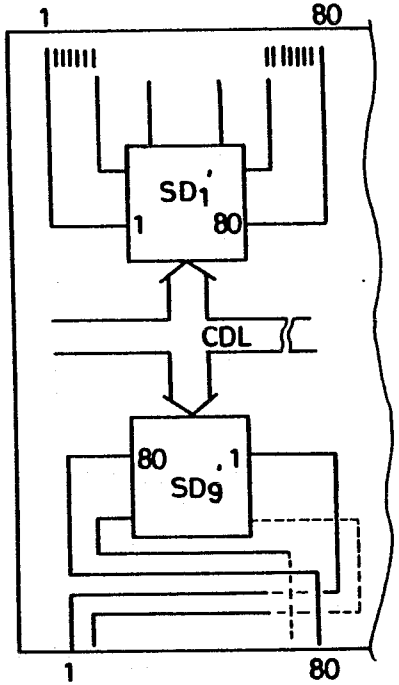
FIG. 2 shows the status in which conventional segment driver LSIs driving LCD are installed.
Figure 4:
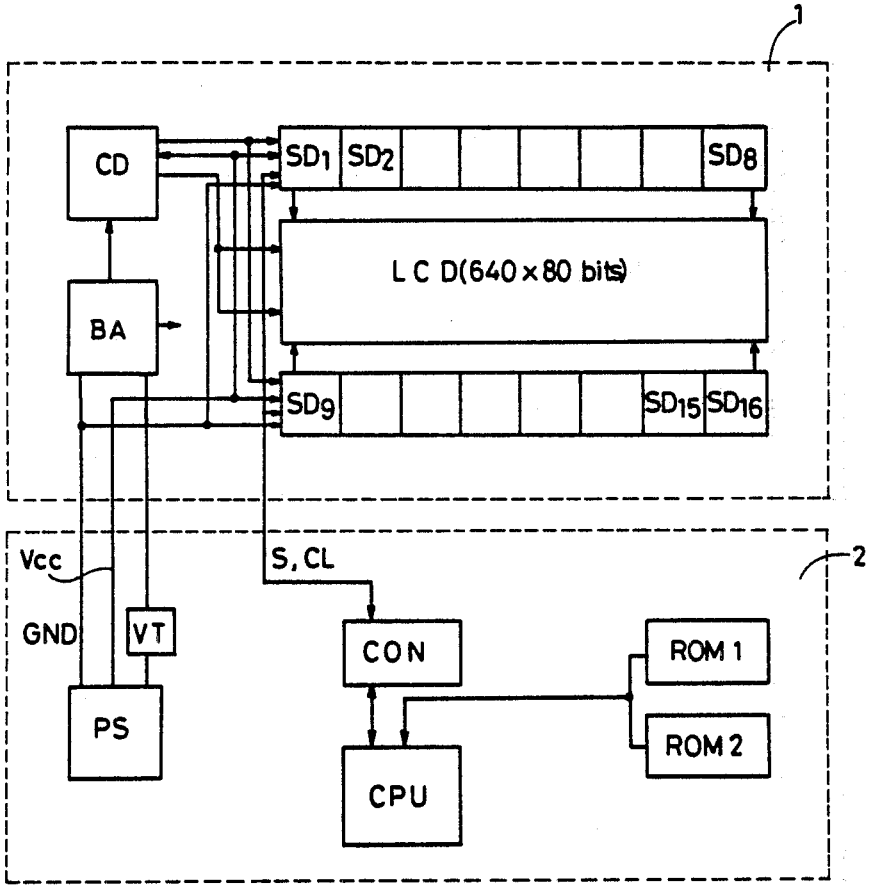
FIG. 4 shows a schematic diagram containing an LCD display controller and the computer using this controller.
Figure 5:
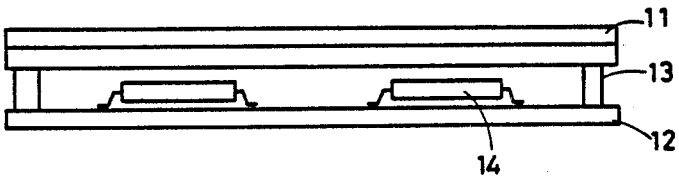
FIG. 5 shows the configuration of an LCD display unit.
Figure 6:
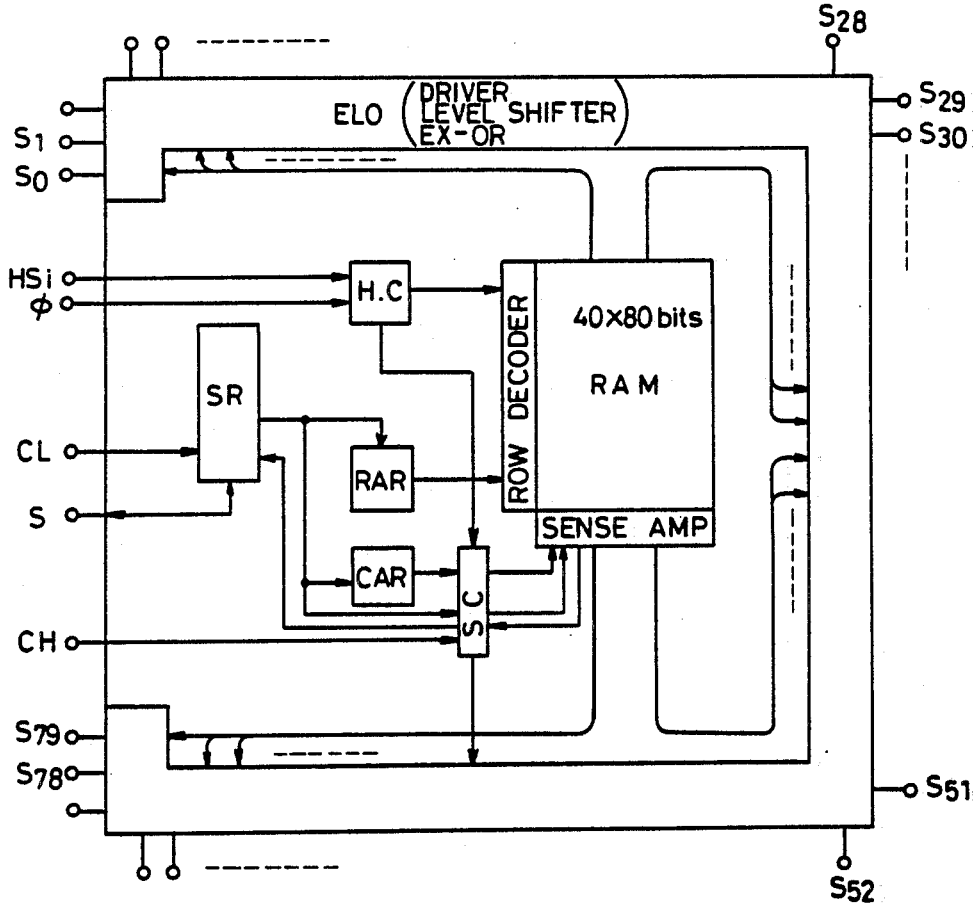
FIG. 6 shows the schematic diagram of the segment driver LSIs according to the preferred embodiment of the present invention.

FIG. 3 shows a preferred embodiment of the present invention in which lead wires between segment driver LSIs SD1, —, SD8, SD9, —, and SD16, and the LCD connector are installed so that they cannot cross each other. CDL denotes the common data line. As shown in FIG. 3, each LSI is provided with a CH terminal. By connecting these CH terminals either to the power voltage Vcc or to the GND, orders and directions of the outgoing segment signals can be selected as required. Details are described below. FIG. 4 shows the schematic diagram containing the LCD display controller and the computer using this controller. Reference number 1 indicates an LCD display unit and number 2 the operation controller. The LCD display unit is made of the LCD display cell 11 and the circuit board 12, which are integrated by the rubber connector 13 as shown in FIG. 5. Reference number 14 in FIG. 5 indicates the segment driver LSIs. LSI SD1 through SD16 are respectively the segment drivers, each driving 80 segment lines. CD denotes the common driver that outputs the back plate signals to the back plate of the LCD cell. BA denotes the buffer amplifier that feeds the LCD drive power voltage to the common driver CD and all the segment drivers SD1 through SD16. The CPU is the microprocessor and CON is the display control circuit that either outputs the display data to these segment drivers SD or reads the display data from these. Data transfer is executed by using serial bits. ROM 1 stores the font patterns of "KANJI" (Chinese characters) and ROM 2 stores the font patterns of alphabetical characters, numerals, and the Japanese "KANA" characters. PS denotes the power circuit that feeds the power voltage Vcc to the buffer amplifier BA, common driver CD, and the segment drivers SD, respectively. VT denotes the circuit that adjusts the variable LCD drive power voltage Vcc and compensates for temperature. The buffer amplifier BA divides the power voltage in order to generate specific power voltages that can sustain the required level. FIG. 6 shows the schematic diagram of an LSI operating as one of the segment drivers SD. RAM denotes a display memory which is actually the 40×80 bit static RAM itself. This causes the segment signals to be eventually fed to S0 through S79 after writing bit patterns that exactly match such dots to be displayed by the LCD cell. In other words, the signal from the display memory RAM is eventually converted into the segment waveform signal by the block ELO which is composed of the EX-OR gate, level shifter (the circuit that converts the operating voltage), and the driver. RAR denotes the row address register and CAR the column address register, each designates either the row addresses or the column addresses of the display memory RAM.

Figures 7, 8:
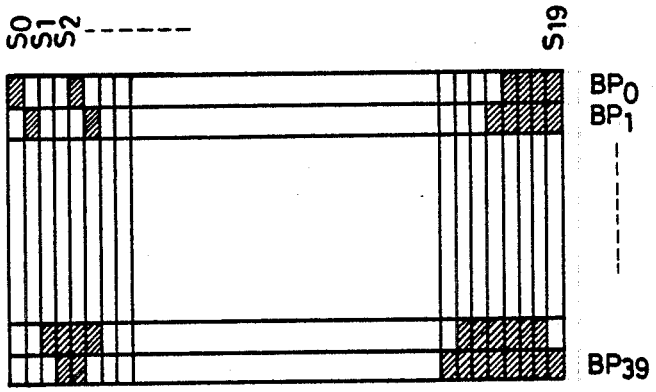
FIG. 7 shows the status of the display memory.
FIG. 8 shows an example of display exactly matching the memory contents of FIG. 7.

FIG. 7 shows the contents stored by the display memory RAM, containing addresses column 0 through column 9 and row 0 through row 39. Each address stores 8-bit patterns. FIG. 8 shows an example of display in conjunction with FIG. 7. Specifically, both the column addresses and the bit position exactly match the segments and the row addresses match such signals in the back plate, respectively. These bit patterns are fed from the terminal S shown in FIG. 6 by using serial bits. SR shown in FIG. 6 denotes the serial register that causes the needed data to be input or output synchronous with the clock signal CL. SC denotes the signal control circuit that first decodes the CAR contents in response to the activated CH terminals before selecting the needed column data stored in RAM. SC either writes the SR contents into RAM, or reads the RAM contents for delivery to SR. HC denotes the counter that synchronizes with the timing of the back plate signals. As described earlier, CH denotes such a terminal that selects the orders and directions of the segment signals.

Figure 9:
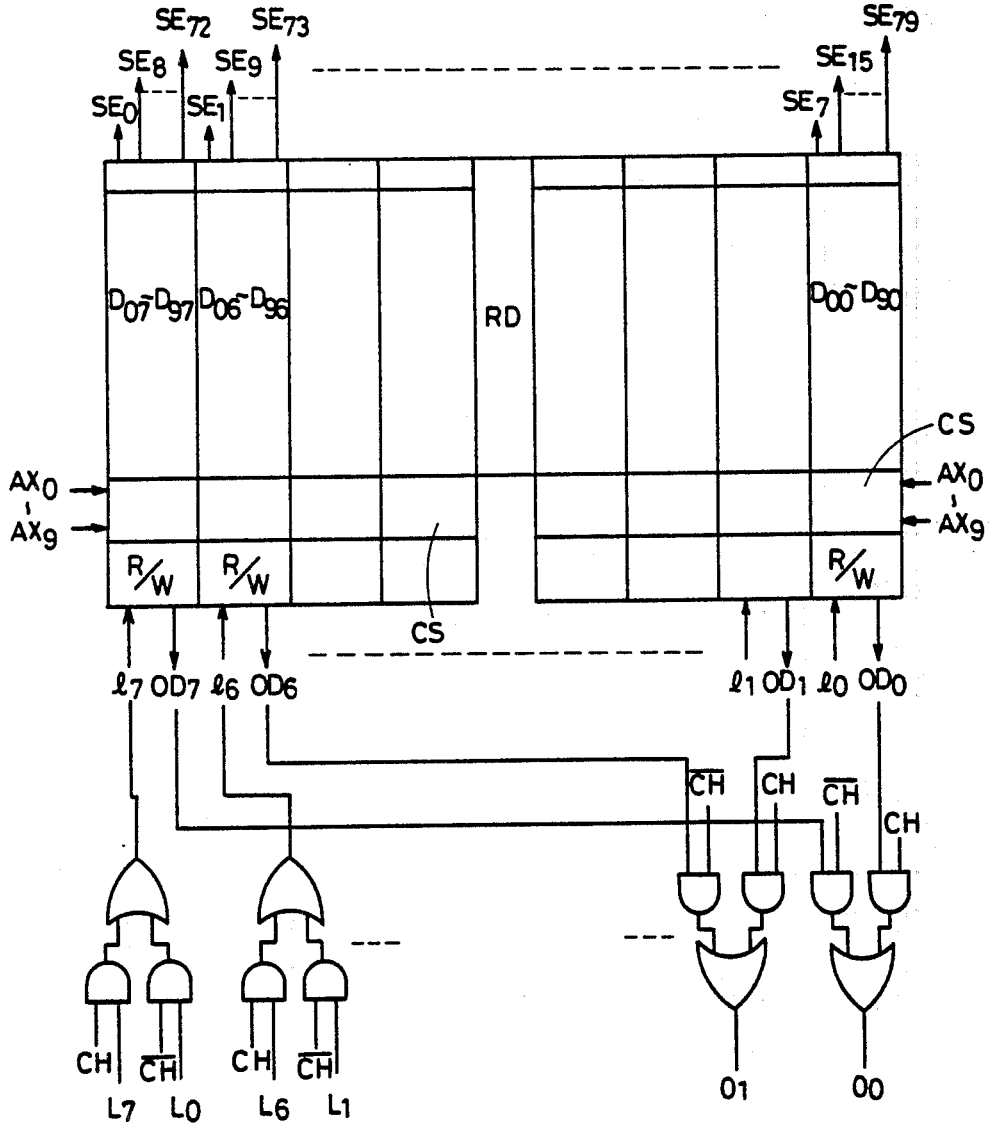
FIG. 9 shows the relationship between the display memory and signals entering and going out of this memory.

FIG. 9 shows the relationship between RAM and signals entering and exiting it. The configuration of this RAM is shown in FIG. 7 in conjunction with dots in the display, whereas FIG. 9 shows the actual configuration of the RAM circuit. Specifically, signals SE0 through SE79 sent out of RAM correspond to those segment signals S0 through S79 shown in FIG. 8, in which, signals SE0, SE3, —, SE72 make up a block. Signals D07 through D97 correspond to 10×40 (row) bits. I0 through I7 are the 8-bit signals entering RAM, whereas OD0 through OD7 are the 8-bit output signal fed from RAM. In response to this input signal, the CPU either sets or resets such bits that are selected by the row decoder RD and the column selector CS. It also reads the contents of those bits selected by the row decoder RD and the column selector CS before delivery to the output OD0 through OD7. R/W denotes the read/-write control circuit.

L0, L1, —, L7 are respectively the 8-bit input data to be written into RAM. If CH=1, data L7 is fed to I7 and data L6 to I6. Data Li is fed to Ii. Conversely, if CH=0, data L0 is fed to I7, L1 to I6, and Li to I7−i, respectively. As a result, in response to the CH status, the bit order of the 1-byte data inverts. On the other hand, those signals entering the column selector CS contain the contents of the column address register CAR that have already been decoded in response to the CH status. The relationship between these is shown by equations below.

$$A6' = CH \cdot A6 + \overline{CH} \cdot \overline{A6}$$

$$A7' = A7$$

$$A8' = CH \cdot A8 + \overline{CH}\,(A3 \oplus A7)$$

-continued $$A9' = CH \cdot A9 + \overline{CH}\,(\overline{A7 + A8} \cdot \overline{A9})$$

where A6 through A9 denote the contents of the column address register and A6′ through A9′ the 4-bit column addresses inverted by CH, respectively. The column addresses and the column selector data are respectively decoded by the relationship shown in table below.

| Column selector | CH = 1 | CH = 0 |
|---|---|---|
| AX0 | 0000 | 1001 |
| AX1 | 0001 | 1000 |
| AX2 | 0010 | 0111 |
| AX3 | 0011 | 0110 |
| AX4 | 0100 | 0101 |
| AX5 | 0101 | 0100 |
| AX6 | 0110 | 0011 |
| AX7 | 0111 | 0010 |
| AX8 | 1000 | 0001 |
| AX9 | 1001 | 0000 |

In other words, these column addresses are also inverted by the CH signals.

Referring to FIG. 9, $0_0$, and 01, —, 07 are respectively the 1-byte output data. If CH=1, OD0 is fed to $0_0$, OD1 to 01, and ODi to Oi. Conversely, if CH=0, OD7 is fed to $0_0$, OD6 to 01, and ODi to 07−i, respectively. Thus, those signals sent to $0_0$ through 07 are then fed to the serial register SR and finally to the operation controller 2.

By executing these operations including the switching of signals at the CH terminals, each segment driver, SD1 through SD8 and SD9 through SD16 shown in FIG. 3 can write the needed display data into the same address in the same direction.

As is clear from the foregoing detailed description, the preferred embodiment of the present invention perfectly eliminates the crossed wiring conventionally applied. In particular, the preferred embodiment of the present invention has made it possible to achieve an extremely useful display drive circuit featuring (1) the maximum availability of all the existing printed circuit boards, (2) the capability to effectively install multi-terminal LSIs within the limitedly available space, and (3) the capability to install a multi-dutied LCD unit as well.

What is claimed is:

1. A display drive circuit for driving a display comprising:

a display memory storing dot patterns for display and developing a plurality of segment signals for supply to said display, said dot patterns being provided by a plurality of input signals, selected locations within said display memory being selected by memory addresses corresponding to positions of various elements of said display; and means for selectively converting said input signal addresses to be supplied said display memory in response to a mode select signal, said means for inverting further selectively inverting output signals developed by said display memory;

said means for inverting facilitating use of said drive circuit with the display having input pins arranged in at least two configurations.

2. The display drive circuit of claim 1 wherein said means for selectively inverting comprises.

input logic means for selectively inverting said input signals to be supplied said display memory, and output logic means for selectively inverting output signals developed by said display memory, said input logic means including an input logic circuit having an OR gate and two AND gates associated with each input signal to said display memory, said output logic means including an output logic circuit having an OR gate and two AND gates associated with each display memory output, each said input logic circuit and output logic circuit receiving said mode select signal at an input of one said AND gate and the logical complement of said mode select signal at the other said AND gate.

3. The display drive of claim 1 wherein said display memory develops said segment signals in parallel for supply to the display.

4. The display drive of claim 1 wherein data to be displayed on said display is input into said display memory as said input signals on a plurality of parallel data input lines.

5. The display drive of claim 1 wherein two configurations of display input pins are necessary, one said configurations of display pins being reversed from the other said configuration of display input pins.

* * * * *